US005425305A

United States Patent [19]

Mauritz

[11] Patent Number: 5,425,305

[45] Date of Patent: Jun. 20, 1995

[54] HYDRAULIC CYLINDER PISTON WITH CENTER FLOW BYPASS VALVE

[76] Inventor: Forrest Mauritz, P.O. Box 458, Monticello, Iowa 52310

[21] Appl. No.: 202,285

[22] Filed: Feb. 25, 1994

[51] Int. Cl.[6] ..... F01B 31/00

[52] U.S. Cl. ..... 92/181 P; 92/85 B; 92/143; 251/325; 91/422; 91/23; 91/399

[58] Field of Search ..... 92/85 B, 143, 181 R, 92/181 P, 183, 184, 128; 91/222, 224, 229, 422, 23, 49, 401, 399; 251/325

[56] References Cited

U.S. PATENT DOCUMENTS

| | | | |
|---|---|---|---|
| 56,898 | 8/1866 | Cabell | 91/401 |
| 94,371 | 8/1869 | Witty | 91/401 |
| 4,729,283 | 3/1988 | Hillier | 91/407 |

FOREIGN PATENT DOCUMENTS

| | | | |
|---|---|---|---|
| 0209085 | 10/1956 | Australia | 251/325 |
| 0928610 | 6/1973 | Canada | 91/401 |
| 0005505 | 1/1983 | Japan | 92/401 |
| 0062704 | 4/1984 | Japan | 91/401 |
| 0065608 | 4/1984 | Japan | 91/401 |
| 2,893 | 10/1869 | United Kingdom | 92/183 |

*Primary Examiner*—Thomas E. Denion
*Attorney, Agent, or Firm*—Allan L. Harms

[57] ABSTRACT

A relief valve for a hydraulic piston consists of a tubular mid-section with closed ends and circular stops at each end. The tubular center section has cross ports at each end that run perpendicularly to the axis of the valve. The cross parts are situated as close to the end stops as possible. The cross ports intersect the hollow center of the spool and allow hydraulic oil to flow through the piston via the passageway in the center of the valve when the valve is in the open position.

28 Claims, 2 Drawing Sheets

HYDRAULIC CYLINDER PISTON WITH CENTER FLOW BYPASS VALVE

BACKGROUND OF THE INVENTION

This invention relates to relief valves for pistons which serve to position equipment or levers.

In many equipment structures, including agricultural implements, hydraulic cylinders are used to raise and lower or otherwise move members of the machine and to retain the members in a position until the hydraulic cylinder is actuated to move the member to a new position. When hydraulic fluid is pumped into the hydraulic cylinder and the piston has traveled fully to the end of the cylinder, the hydraulic pump supplying fluid to the cylinder continues to apply pressure to the fluid and must be stopped to avoid an over pressure condition which stresses and damages the cylinder end cap and head gland. In some existing systems, timer mechanisms are operable with the hydraulic pump to shut the pump off after the estimated time it takes for the piston to travel to an end of the cylinder. At best, this only approximates efficient operation.

In other prior art devices, a transducer is provided on the hydraulic cylinder to sense when a predetermined pressure is attained in the fluid input line. The transducer either sends a signal to the pump control to stop pumping, or to a switch valve to bypass the input line so that over stress conditions do not occur. The use of a transducer system requires addition of control apparatus to the hydraulic system.

Another prior art means for avoiding an over stress condition in the cylinder is by means of a relief valve in the cylinder or in the input line. This apparatus causes high heat build up and stress on the hydraulic pump.

A relief valve for a hydraulic piston is used in equipment manufactured by the Marathon Equipment Co. for compaction equipment, wherein a bypass valve member is positioned within a bore through the hydraulic piston such that the valve is displaced when its leading end engages the head gland of the cylinder. When the valve is displaced, a central reduced diameter portion of the valve spool comes into registry with a pair of axial passageways which communicate with the edge of the piston. In this design the hydraulic fluid is routed around the outside of the valve spool in a manner similar to typical manual control valves. The design requires special machining operations in the piston to provide fluid passageways. The machining required to create the passageways adds considerable expense to the fabrication of the piston. This previous design depends on extremely tight spool-to-bore clearance to minimize leakage in the closed position. The tight clearance makes the valve vulnerable to malfunction if there are machining inaccuracies in the piston or valve. Also the valve function becomes very sensitive to minute particles of contamination that could wedge between the spool and bore. As the outside diameter of the spool becomes worn, the hydraulic fluid leakage will increase, reducing the efficiency of the cylinder. Further, this prior design valve only works when the piston is advanced in one direction and it is found to tend toward premature exhaustion.

Another prior art device comprises a spring loaded relief valve positioned through the piston allowing a passageway for fluid to escape from the advancing side of the piston to the following side when the valve is urged against its spring loading by engagement of the leading end of the valve with the cylinder end wall. As with the Marathon Equipment Co. design valve, the bore through the piston requires complicated machining to provide valve seats and spring engaging shoulders. This valve structure causes heat build up, operates only in one direction of movement of the piston, and is subject to premature wear.

SUMMARY OF THE INVENTION

The invention relates to a valve mounted in a hydraulic cylinder piston that allows hydraulic fluid flow through the piston at the end of either the extend or retract stroke. The valve is opened as it makes contact with either the end cap or head gland inside the cylinder. The valve is closed by pressure when hydraulic fluid flow is reversed to the cylinder after reaching the end of the stroke. The purpose of the valve is to relieve pressure-induced loading on the end cap or head gland of the cylinder and to minimize problems with metal fatigue. The hydraulic energy expended by the cylinder is utilized in moving a load and not wasted by deadheading the pump at the end of stroke.

The valve is slideably mounted in a close-fitting bore running through the piston. The valve bore is offset from and parallel with the piston center line. The valve is free to slide back and forth within the bore.

The valve spool consists of a tubular mid-section with closed ends and circular stops at each end. The tubular center section has cross ports at each end that run perpendicularly to the axis of the valve. The cross parts are situated as close to the end stops as possible. The cross ports intersect the hollow center of the spool and allow hydraulic oil to flow through the piston via the passageway in the center of the valve when the valve is in the open position.

The circular stops on the valve serve three functions: first, the stops limit the spool travel and prevent it from escaping from the bore. Secondly, the stops function as poppet valves to cut off flow of hydraulic fluid when they contact the surface of the piston. Thirdly, the stops act as a spear-type cushion when they enter a small hydraulic dash pot machined in the piston at each end of the bore where the spool is mounted. The cushion diminishes the shock as the valve shifts, and improves the long-term reliability of the valve.

This invention reduces the complexity and improves the performance of the valve. The new design does not require the drilling of hydraulic oil passageways within the piston. All flow is directed through the center of the valve spool. The elimination of the drilled fluid passageways provides a considerable cost savings.

It is an object of the invention to provide a relief valve for a hydraulic piston which is simple and inexpensive to manufacture and assemble. It is also an object of the invention to provide a relief valve for a hydraulic piston which allows minimal leakage of working fluid when the valve is closed. It is a further object of the invention to provide a relief valve for a hydraulic piston which cushions itself when changing state. It is also an object of the invention to provide a hydraulic piston with a relief valve which operates to alleviate stress on the end cap and head gland of the cylinder in which the piston is driven. It is a further object of the invention to provide a hydraulic cylinder and piston with a relief valve which is not susceptible to heat build up. Another object of the invention is to provide a relief valve, the stops of which wear together with their seating surfaces to create improved sealing as use continues. These and other objects will be apparent from examination of the detailed description which follows.

DESCRIPTION OF THE DRAWING FIGURES

FIG. 4 is a partly cut away elevation of the hydraulic cylinder of FIG. 3 showing the preferred embodiment hydraulic piston with relief valve in cross section, with the piston at the end of its retract stroke and with the valve being in its intermediate state with a passageway established for working fluid to pass through.

DETAILED DESCRIPTION OF THE INVENTION

Figure 1:
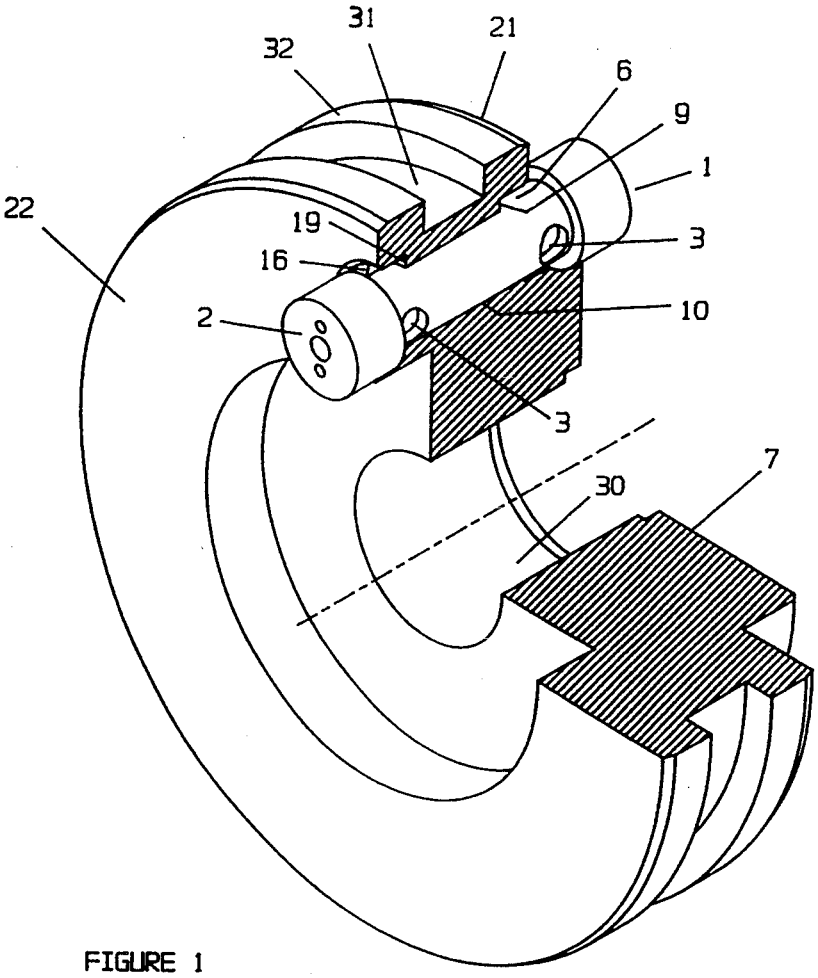
FIG. 1 is a cross sectional view in perspective of the preferred embodiment hydraulic piston with the center flow bypass valve in place.
Figure 2:
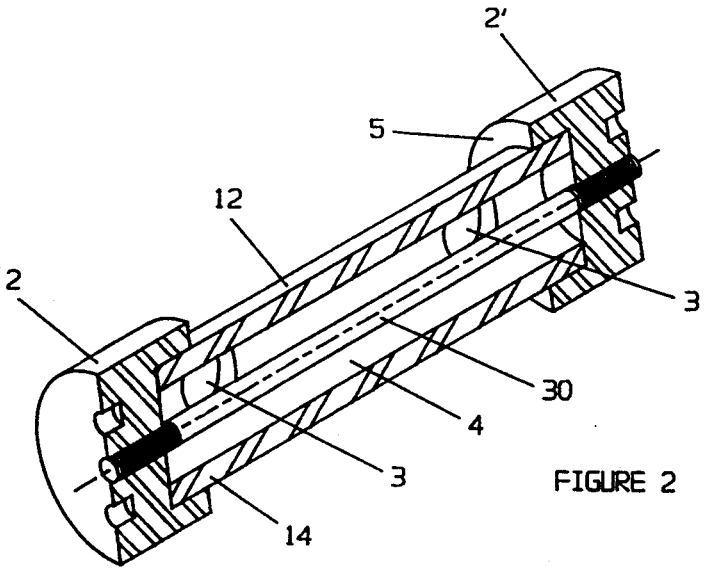
FIG. 2 is a cross sectional view in perspective of the bypass valve of the preferred embodiment.

Referring to the drawing figures and in particular to FIGS. 1 and 2, the preferred embodiment hydraulic piston 7 is disclosed. The hydraulic piston 7 is provided with an axial opening 30 into which a piston rod (not shown) is receivable. Edge 32 of piston 7 is provided with channel 31 into which a sealing ring 33 (See FIG. 3) may be received. The hydraulic piston 7 is provided with a bore 10 therethrough which is axially parallel to the axis of the piston 7 and is spaced apart therefrom. Counterbores 6 and 16 are made on the opposing faces 21, 22 of the piston 7, the counterbores 6 and 16 being coaxial with the bore 10 through the piston 7 and of a fixed depth. A valve spool 12 of cylindrical configuration is receivable within the bore 10 of the piston 7 in a close fit yet slidable therewithin. The valve spool 12 is provided with an internal axial passageway 4 and with at least two radial ports 3 along the length of the spool 12, the ports 3 being communicative with the internal passageway 4 of the valve spool 12. The ports 3 are positioned such that they are generally symmetrically located along the valve spool 12 and spaced apart somewhat more than the length of the bore 10 between the counterbores 6 and 16. Each port is immediately adjacent to a stop member 2 or 2'. In the preferred embodiment, ports 3 are formed by cross drilling the valve spool 12 resulting in pairs of diagonally opposed paired ports 3 near the ends of valve spool 12.

The valve spool 12 is provided with stops 2 and 2' which are suitably fixed to the valve spool 12 and which serve to enclose the ends of the axial bore 4 through the valve spool 12. In the preferred embodiment, stop members 2 and 2' are retained to spool 12 by threaded shaft 30. Each of stop members 2 and 2' is cylindrical in shape and is sized such that each will freely fit within the counterbores 6 and 16 on the faces 21 and 22 of the piston 7. When stop 2' is fully received in counterbore 6, the inner face 5 of stop 2' will abut seat 9 of counterbore 6. Stop 2 is identically receivable in counterbore 16 upon seat 19 therein. The radial ports 3 of the valve spool 12 are disposed along valve spool 12 such that when one stop 2' of the valve 1 is abutted with the seat 9 of counterbore 6 of first face 21 of piston 7, the port 3 nearest the abutting stop 2' will be within the bore 10 through the piston 7, while the port 3 on the opposing end of the valve spool 12 will be in communication with the counterbore 16 of the other face of the piston 7.

Counterbores 6 and 16 serve as hydraulic dash pots for stop members 2' and 2 respectively when either is urged toward bore 10. Stop members 2 and 2' act like poppet valves in their interaction with counterbores 16 and 6, each preventing working fluid from passing through bore 10 when the stop member is fully seated in its respective counterbore. The presence of working fluid in counterbores 6 and 16 allows for a cushioning of stops 2 and 2' when they seat in the counterbores 6 and 16.

Figure 3:
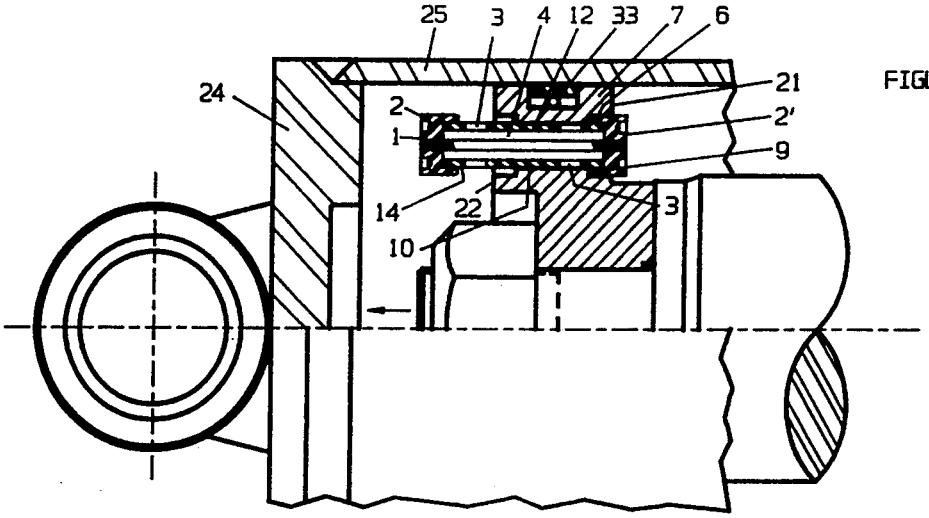
FIG. 3 is a partly cut away elevation of a hydraulic cylinder equipped with the preferred embodiment piston in its retract stroke, the piston valve shown in cross section, with the valve of the piston being in its first closed state with no working fluid passing through the valve.
Figure 4:
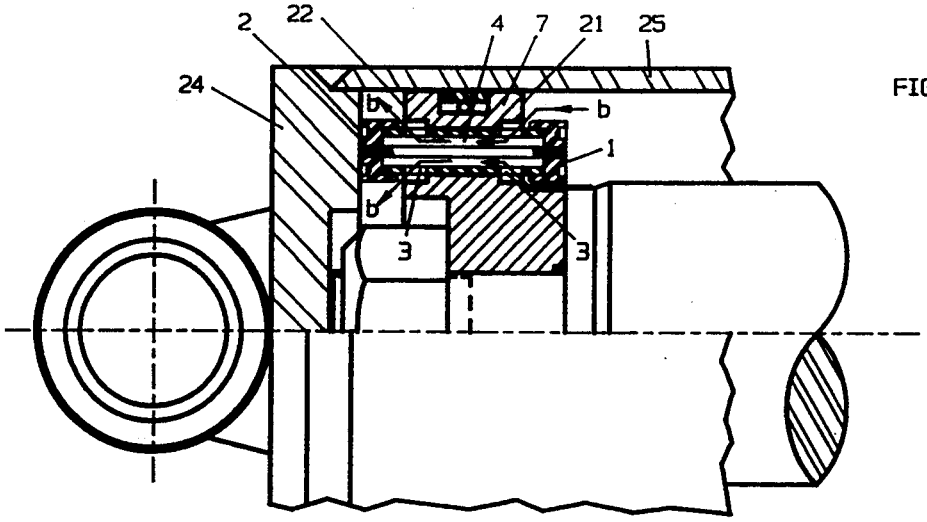
Figure 5:
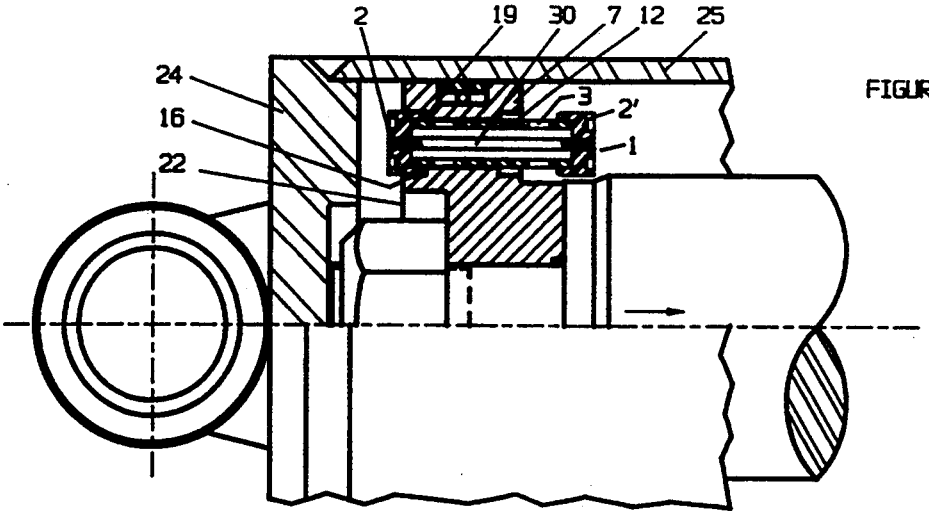
FIG. 5 is a partly cut away elevation of the hydraulic cylinder of FIG. 3 showing the preferred embodiment hydraulic piston with relief valve in cross section, the piston shown at the beginning of its extend stroke and with the valve being in its second closed state.

Referring to FIGS. 3, 4, and 5 in particular, operation of the valve may be visualized. When working fluid is applied to the first face 21 of the hydraulic piston, the working fluid forces the relief valve 1 along the bore 10 through the piston 7 to a first state where the stop 2 of the relief valve 1 abuts the seat 9 of the counterbore 6 on the first face 21 of the piston 7. As the piston 7 approaches the end cap 24 of the cylinder, the stop 2 on the first end 14 of the valve spool 12 which protrudes from the second face 22 of the piston 7 engages the end cap 24 of the cylinder 25 and is urged through the bore 10 of the piston 7 toward the trailing first face 21 of the piston 7. As the valve spool 12 slides through the bore 10 toward the first face 21 of the piston 7 into an intermediate position, the radial ports 3 of the valve spool 12 reach alignment (See FIG. 4) with the counterbore 6 and 16 on faces 21 and 22 respectively, of the piston 7, and a passageway is created from the counterbore 6 on the first face 21 of the piston 7 through the radial port 3 on the valve spool 12 nearest the first face 21 of the piston 7 through the internal bore 4 of the valve spool 12 and through the radial port 3 on the first end 14 of the valve spool 12 into the counterbore 16 on the second face 22 of the piston 7. When the passageway is so created, working fluid is allowed to pass from the first face 21 of the piston 7, in the direction of arrows b, to the second face 22, thereby reducing pressure on the first face 21 of the piston 7.

When working fluid is directed to the cylinder 25 to reverse the movement of the piston 7 into an extend stroke, the roles of the leading and trailing faces of the piston 7 reverse. Pressure of the working fluid causes the relief valve 1 to rapidly slide from its position abutting the end cap 24 of the cylinder 25 into a second state where the valve 1 in engagement with the pressurized working fluid is urged into the bore 10 through the piston 7 until the stop 2 on first end 14 abuts the seat 19 within the counterbore 16 on the second face 22 of the piston 7 which has become the trailing face of the piston 7. When the valve 1 is so positioned, no passageway is provided through the valve 1 or the bore 10 in the piston 7 and the piston 7 is urged toward the head gland (not shown) opposing the end cap of the cylinder 25. As the piston 7 approaches the head gland, the end of the valve 1 protruding from the advancing first face 21 of the piston 7 engages the head gland of the cylinder 25 and is forced rearward relative to the piston's advance, to the intermediate position where the passageway through the bore 10 of the piston 7 by way of the internal bore 4 of the valve 1 is established and working fluid may pass to the first side of the piston 7 to reduce the pressure and avoid stress on the head gland.

It is found that the disclosed design requires far simpler machining operations than that required for prior art valve structures, and that heat build up and premature failure are avoided. It is also found that the stop 2 to seat 9 abutment creates a tight seat for the valve 1 and that cushioning by residually present working fluid is provided as the stop 2' and seat 9 of counterbore 6 engage. The same dash pot function is similarly provided by stop 2 and seat 19 in counterbore 16.

It is to be understood that in the preferred embodiment of the valve 1 shown in FIGS. 1 and 2, the valve spool 12 is provided with diametrically opposing radial ports 3. The use of opposing ports simplifies the machining of the valve spool 12 and alleviates stresses between the bore 10 and the valve spool 12.

In FIGS. 3, 4, and 5 it can be seen that the stops 2 and 2' of the valve 1 may be retained by use of a central stud 30 which passes through internal bore 4 of valve spool 12 and retains stops 2, and 2' by screw threading or other securing means.

Having described the invention, I claim:

1. A piston reciprocable within a hydraulic cylinder having a end cap and head gland on the ends thereof, comprising the piston having a bore therethrough, said bore being spaced apart from and axially parallel to the axis of said piston, an elongate valve spool slidably receivable in said bore, said spool having two opposing ends and an axial passageway therethrough, said spool having stop members fixed to each end thereof, said stop members enclosing said passageway of said spool, said spool being longer than said bore, said spool having at least two radial ports therealong communicative with the passageway of said spool, one of said at least two pods immediately adjacent a first of said stop members, the other of said at least two ports immediately adjacent the other of said stop members, a first of said at least two ports spaced apart from said other of said at least two ports a distance greater than the length of said bore.

2. The piston of claim 1 wherein counterbores are provided upon each end of said bore of said piston, said counterbores are coaxial with said bore, said stop members are cylindrical and coaxial with said valve spool, said stop members are slidably receivable in said counterbores, said stop members interact with said counterbore to provide a seal therebetween.

3. The piston of claim 1 wherein said at least two ports are two pairs of diametrically opposed ports.

4. The piston of claim 2 wherein each of said stop members having an annular inner face thereon, each of said counterbores having a seat portion therein, said inner faces of said stop members abutting the seat portions of said counterbores to effect a seal therewith.

5. The piston of claim 4 wherein said stop members and said counterbores comprise poppet valves and seats.

6. The piston of claim 5 wherein said stop members being longer than the depth of said counterbores, each of said stop members having an end wall thereon, the end wall of a first of said stop members engageable with the end cap of said cylinder when said piston approaches said end cap, said first stop member when in engagement with said end cap being urged toward said piston, the end wall of the other of said stop members engageable with the head gland of said cylinder when said piston approaches said head gland, said other stop member when in engagement with said head gland being urged toward said piston.

7. The piston of claim 1 wherein said stop members are identical.

8. 22. The piston of claim 2 wherein each of said stop members having an inner face thereon, said inner face of each stop member defining a plane substantially perpendicular to the axis of said valve spool, each of said counterbores having a seat portion therein, the seat portion of each counterbore defining a plane perpendicular to the axis of the counterbore.

9. In a piston reciprocable in a hydraulic cylinder, said piston having a relief valve associated therewith to permit selective passage of working fluid from one side of the piston to the other side of the piston, the improvement comprising said piston having a first face on one side of the piston and a second face on the other side of the piston, said piston having a bore therethrough from one face of the piston to the other face thereof, said bore spaced apart from the axis of said piston, said bore provided with coaxial counterbores on the faces of the piston, a tubular body slidably receivable within said bore, the length of said bore between said counterbores being less than the length of said tubular body, said tubular body having a sidewall and two ends, said sidewall defining an axial passageway through said tubular body, stop members fixed to the ends of said tubular body and enclosing said passageway, said sidewall having a first port positioned along said sidewall and adjacent to one of said ends of said tubular body, said sidewall having a second port positioned along said sidewall and adjacent to the other end of said tubular body, said ports being communicative with said passageway, said ports spaced apart a distance longer than the length of said bore between said counterbores.

10. The piston of claim 9 wherein said first port is a first pair of diametrically opposing ports disposed along said sidewall and adjacent to one of said ends of said tubular body, said second port is a second pair of diametrically opposing ports disposed along said sidewall and adjacent to the other end of said tubular body, said ports being communicative with said passageway, said pairs of ports spaced apart a distance longer than the length of said bore.

11. The piston of claim 10 wherein said ports are formed by cross drilling diagonally through said tubular body.

12. The piston of claim 9 wherein said stop members are cylindrical and coaxial with said tubular body, said stop members are slidably receivable in said counterbores.

13. The piston of claim 9 wherein said counterbores comprising dashpots, said stop members being cushioned by working fluid in said dashpots.

14. The piston of claim 9 wherein said stop members and said counterbores comprise poppet valves and seats therefor.

15. The piston of claim 9 wherein said stop members are receivable in said counterbores, each of said stop members having an annular inner face thereon, each of said counterbores having a seat portion therein, said inner faces of said stop members abutting the seat portions of said counterbores to effect a seal therewith.

16. The piston of claim 9 wherein said stop members being longer than the depth of said counterbores, each of said stop members having an end wall thereon, the end wall of a first of said stop members engageable with the end cap of said cylinder when said piston approaches said end cap, said first stop member when in engagement with said end cap being urged toward said piston, the outer wall of the other of said stop members engageable with the head gland of said cylinder when said piston approaches said head gland, said other stop member when in engagement with said head gland being urged toward said piston.

17. The piston of claim 9 wherein said stop members of said tubular body are identical.

18. The piston of claim 9 wherein said stop members are receivable in said counterbores, each of said stop members having an inner face thereon, each of said counterbores having a seat portion therein, said inner face of each stop member defining a plane substantially perpendicular to the axis of said valve spool, the seat portion of each counterbore defining a plane perpendicular to the axis of the counterbore.

19. A relief valve for a piston reciprocable within a hydraulic cylinder having a head gland and an end cap, comprising a tubular body with opposing ends, stop members fixed to each of the ends of the tubular body, said tubular body having an axial passageway therethrough, said tubular body having two radially disposed ports therein communicative with said passageway, said ports spaced apart axially along said body, said piston having an opening therethrough which is axially parallel to the axis of the piston, said tubular body slidable within said opening of said piston, said ports of said tubular body spaced apart a length greater than the length of said opening of said piston, one of said ports associated with a first of said stop members, the other of said ports associated with the other of said stop members, each of said ports disposed along said tubular body such that one port is within said opening when the stop member with which it is associated is abutted to said piston.

20. The valve of claim 19 wherein said stop members being coaxial with said tubular body, said opening of said piston having opposing ends thereon, said piston having coaxial counterbores at each end of said opening, said counterbores coaxial with said opening, said stop members being cylindrical, each of said stop members slidably receivable within one of said counterbores when said tubular body is received in said opening of said piston.

21. The valve of claim 20 wherein each of said counterbores having an inner annular surface thereon, each of said stop members having an annular face abuttable with the inner annular surface of the counterbore in which is it is received, the annular face of each of said stop members cooperating with the annular surface of the counterbore in which the stop member is received to form a seal when abutted.

22. The valve of claim 21 wherein said stop members operating as a popper valve.

23. The valve of claim 21 wherein one of said stop members interactive with said end cap of said cylinder to urge said tubular body in opposition to the movement of the piston, the other of said stop members interactive with said head gland of said cylinder to urge said tubular body in opposition to the movement of the piston.

24. The valve of claim 23 wherein said stop members are fixed to said tubular body by a threaded shaft through said passageway, said first port is a first pair of diametrically opposing ports disposed along said sidewall and adjacent to one of said ends of said tubular body, said second port is a second pair of diametrically opposing ports disposed along said sidewall and adjacent to the other end of said tubular body, said ports being communicative with said passageway, said pairs of ports spaced apart a distance longer than the length of said bore.

25. The valve of claim 19 wherein said stop members are identical.

26. The valve of claim 19 wherein each of said stop members having an inner face thereon, said inner face of each stop member defining a plane substantially perpendicular to the axis of said valve spool, each of said counterbores having a seat portion therein, the seat portion of each counterbore defining a plane perpendicular to the axis of the counterbore.

27. A piston reciprocable within a hydraulic cylinder having a head gland and base gland on the ends thereof, comprising the piston having a bore therethrough, said bore being spaced apart from and axially parallel to the axis of said piston, an elongate valve spool slidably receivable in said bore, said spool having two opposing ends and an axial passageway therethrough, said spool having stop members fixed to each end thereof, said stop members enclosing said passageway of said spool, said spool being longer than said bore, said spool having at least two radial ports therealong communicative with the passageway of said spool, one of said at least two ports immediately adjacent a first of said stop members, the other of said at least two ports immediately adjacent the other of said stop members, a portion of a first of said at least two ports spaced apart from a portion of said other of said at least two ports a distance greater than the length of said bore.

28. In a piston reciprocable in a hydraulic cylinder, said piston having a relief valve associated therewith to permit selective passage of working fluid from one side of the piston to the other side of the piston, the improvement comprising said piston having a first face on one side of the piston and a second face on the other side of the piston, said piston having a bore therethrough from one face of the piston to the other face thereof, said bore spaced apart from the axis of said piston, said bore provided with coaxial counterbores on the faces of the piston, a tubular body slidably receivable within said bore, the length of said bore between said counterbores being less than the length of said tubular body, said tubular body having a sidewall and two ends, said sidewall defining an axial passageway through said tubular body, stop members fixed to the ends of said tubular body and enclosing said passageway, said sidewall having a first port positioned along said sidewall and adjacent to one of said ends of said tubular body, said sidewall having a second port positioned along said sidewall and adjacent to the other end of said tubular body, said ports being communicative with said passageway, a portion of said first of said ports spaced apart from a portion of said second of said ports a distance longer than the length of said bore between said counterbores.

* * * * *